US010876076B2

(12) United States Patent
Kropf et al.

(10) Patent No.: US 10,876,076 B2
(45) **Date of Patent: *Dec. 29, 2020**

(54) DETERGENTS AND CLEANING AGENTS HAVING IMPROVED PERFORMANCE

(71) Applicant: Henkel AG & Co. KGaA, Duesseldorf (DE)

(72) Inventors: Christian Kropf, Hilden (DE); Rainer Jeschke, Duesseldorf (DE); Sascha Schaefer, Mettmann (DE); Christian Umbreit, Neuss (DE); Alexander Schulz, Essen (DE); Michael Strotz, Cologne (DE)

(73) Assignee: Henkel AG & Co. KGaA

( * ) Notice: Subject to any disclaimer, the term of this patent is extended or adjusted under 35 U.S.C. 154(b) by 0 days.

This patent is subject to a terminal disclaimer.

(21) Appl. No.: 16/270,123

(22) Filed: Feb. 7, 2019

(65) Prior Publication Data

US 2019/0169544 A1 Jun. 6, 2019

Related U.S. Application Data

(63) Continuation of application No. PCT/EP2017/069371, filed on Aug. 1, 2017.

(30) Foreign Application Priority Data

Aug. 8, 2016 (DE) ..... 10 2016 214 660

(51) Int. Cl.

| | |
|---|---|
| ***C11D 7/26*** | (2006.01) |
| ***C11D 7/32*** | (2006.01) |
| ***C11D 3/32*** | (2006.01) |
| ***C11D 3/39*** | (2006.01) |
| ***C11D 3/30*** | (2006.01) |
| ***C11D 7/22*** | (2006.01) |
| ***C11D 11/00*** | (2006.01) |

(52) U.S. Cl.

CPC ..... *C11D 3/32* (2013.01); *C11D 3/30* (2013.01); *C11D 3/391* (2013.01); *C11D 3/3915* (2013.01); *C11D 3/3917* (2013.01); *C11D 7/22* (2013.01); *C11D 7/3263* (2013.01); *C11D 11/0017* (2013.01)

(58) Field of Classification Search

CPC ..... C11D 3/391; C11D 3/3915; C11D 3/3917; C11D 3/30; C11D 3/32; C11D 7/22; C11D 7/3263; C11D 11/0017

USPC ..... 510/313, 501, 502, 505; 8/111, 137

See application file for complete search history.

(56) References Cited

U.S. PATENT DOCUMENTS

| | | | | |
|---|---|---|---|---|
| 2006/0217281 | A1* | 9/2006 | Vogt | C02F 1/72 510/312 |
| 2017/0240849 | A1* | 8/2017 | Kropf | C11D 3/2086 |

FOREIGN PATENT DOCUMENTS

| | | | | |
|---|---|---|---|---|
| DE | 102011088982 | A1 | 6/2013 | |
| DE | 102014222833 | A1 | 5/2016 | |
| WO | 2011023716 | A1 | 3/2011 | |
| WO | 2013092263 | A1 | 6/2013 | |
| WO | WO-2016074936 | A1 * | 5/2016 | C11D 3/2086 |

OTHER PUBLICATIONS

Jurchen, Kristy M. Clarke et al. "A Bidentate Terephthalamide Ligand, TAMmeg, as an Entry into Terephthalamide-Containing Therapeutic Iron Chelating Agents". Inorganic Chemistry. Feb. 18, 2006. vol. 45, No. 6. pp. 2438-2447. XP55415230A.

PCT International Search Report PCT/EP2017/069371 Completed: Oct. 13, 2017; dated Oct. 20, 2017 2 pages.

* cited by examiner

*Primary Examiner* — Gregory R Delcotto

(74) *Attorney, Agent, or Firm* — Thomas G. Krivulka

(57) ABSTRACT

A method for use of substituted dihydroxyterephthalic acid amides in detergents and cleaning agents, for improving detergent or cleaning performance with respect to bleachable stains.

5 Claims, No Drawings

DETERGENTS AND CLEANING AGENTS HAVING IMPROVED PERFORMANCE

FIELD OF THE INVENTION

The present invention relates to the use of dihydroxyterephthalic acid derivates in washing and cleaning agents for improving the washing or cleaning performance.

BACKGROUND OF THE INVENTION

Whereas the formulation of powdered washing and cleaning agents that contain bleaching agent presents no problems nowadays, the formulation of stable, liquid washing and cleaning agents that contain bleaching agent continues to pose a problem. Due to the conventional lack of bleaching agent in liquid washing and cleaning agents, stains which are normally removed in particular due to the contained bleaching agent are correspondingly often only insufficiently removed. A similar problem also exists for bleaching agent-free color detergents in which the bleaching agent is omitted in order to protect the dyes in the textile and prevent the bleaching thereof. In the absence of bleaching agent, this is aggravated by the fact that, instead of removing bleachable stains which are normally at least partially removed by using peroxygen-based bleaching agents, in contrast the washing process often even causes an intensification and/or worsening of the removability of the stain, and this should not least be attributed to initiated chemical reactions which can consist for example in the polymerization of particular dyes contained in the stains.

Problems of this kind occur in particular on stains which contain polymerizable substances. The polymerizable substances are primarily polyphenolic dyes, preferably flavonoids, in particular from the class of anthocyanidins or anthocyanins. The stains may have been caused in particular by food products or beverages which contain corresponding dyes. The stains can be marks from fruit or vegetables or even red wine marks, which contain in particular polyphenolic dyes, especially those from the class of anthocyanidins or anthocyanins.

The international patent application WO 2011/023716 A1 discloses the use of gallic acid esters such as propyl gallate in washing and cleaning agents for improved removal of stains which contain polymerizable substances.

The international patent application WO 2013/092263 A1 relates to improving the performance of washing and cleaning agents by using oligohydroxybenzoic acid amides.

Surprisingly, it has been found that, by using substituted dihydroxyterephthalic acid amides, the washing or cleaning performance of washing or cleaning agents can be greatly improved, in particular with regard to bleachable stains.

BRIEF SUMMARY OF THE INVENTION

The present invention therefore first relates to the use of compounds of general formula (I), (I)

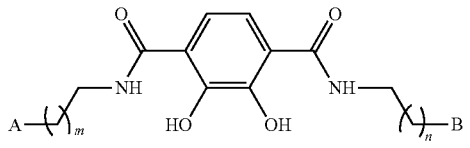

in which m and n, independently of one another, represent 0 to 5, and A and B, independently of one another, represent $—NR^1R^2$, $—N^+R^1R^2R^3X^-$, $—SO_3H$ or $—SO_3^-Y^+$, and $R^1$, $R^2$ and $R^3$, independently of one another, represent H or a straight-chain or branched-chain aliphatic hydrocarbon functional group having 1 to 3, preferably 1 to 2, carbon atoms, $X^-$ represents an anion and $Y^+$ represents an alkali metal cation or an ammonium ion, in washing or cleaning agents in order to improve the washing or cleaning performance on bleachable stains.

As mentioned above, bleachable stains are those which are at least partially removed by using peroxygen-based bleaching agents, for example sodium percarbonate in combination with tetraacetylethylenediamine. The bleachable stains typically contain polymerizable substances, in particular polymerizable dyes, the polymerizable dyes preferably being polyphenolic dyes, in particular flavonoids, especially anthocyanidins or anthocyanins or oligomers of said compounds. In addition to removing stains in the colors green, yellow, red or blue, it is also possible to remove stains in intermediate colors, in particular violet, lilac, brown, purple or pink, and also to remove stains which have a green, yellow, red, violet, lilac, brown, purple, pink or blue hue but do not substantially consist entirely of this color. The mentioned colors can in particular also each be light or dark. The bleachable stains are preferably stains, in particular marks from grass, fruit or vegetables, in particular also stains from food products, such as spices, sauces, chutneys, curries, purees and jams, or drinks, such as coffee, tea, wine and juices, which contain the corresponding green, yellow, red, violet, lilac, brown, purple, pink and/or blue dyes.

The stains to be removed according to the invention can in particular be caused by cherries, morello cherries, grapes, apples, pomegranates, chokeberries, plums, sea buckthorns, acai, kiwifruit, mango, grass, or berries, especially by redcurrants or blackcurrants, elderberries, blackberries, raspberries, blueberries, lingonberries, cranberries, strawberries or bilberries, by coffee, tea, red cabbage, blood orange, eggplant, tomato, carrots, beetroot, spinach, paprika, red or blue potatoes, or red onions.

Of the compounds of general formula (I), those in which A and B are the same are preferred. $X^-$ is preferably selected from the group comprising lactate, citrate, tartrate, succinate, perchlorate, tetrafluoroborate, hexafluorophosphate, alkyl sulfonate, alkyl sulfate, hydrogen sulfate, sulfate, dihydrogen phosphate, hydrogen phosphate, phosphate, isocyanate, thiocyanate, nitrate, fluoride, chloride, bromide, hydrogen carbonate and carbonate and mixtures of at least two thereof, it being possible to ensure the charge equalization in the presence of polyvalent anions by the presence of a corresponding plurality of cationic backbones of general formula I or optionally by the presence of additional cations such as sodium or ammonium ions. $Y^+$ is preferably selected from the group comprising sodium ions, potassium ions and mixtures thereof. In other preferred embodiments of compounds of general formula (I), m and n are, independently of one another, 1 or 2 and/or m and n are the same.

DETAILED DESCRIPTION OF THE INVENTION

Compounds of general formula (I) preferably have a solubility in deionized water of pH 7 at room temperature of at least 10 g/l, in particular at least 50 g/l.

The use according to the invention of the compound of general formula (I) preferably occurs in washing or cleaning agents in that the compound is used in an amount of from 0.001 wt. % to 20 wt. %, in particular in an amount of from 0.01 wt. % to 10 wt. %, with the quantities in "wt. %" in each case here and in the following being based on the weight of the total washing or cleaning agent. The invention therefore further relates to a washing or cleaning agent containing from 0.001 wt. % to 20 wt. %, in particular from 0.01 wt. % to 10 wt. %, of compound of general formula (I), the preferred embodiments described above or below in conjunction with the use according to the invention also applying to this subject matter of the invention, and conversely the preferred embodiments described in conjunction with agents according to the invention also applying to the use aspect of the invention.

The washing or cleaning agent can be present in any dosage form established in the prior art and/or in any expedient dosage form. These include, for example, solid, powdered, liquid, gel or pasty dosage forms, optionally also consisting of a plurality of phases; these also include, for example: extrudates, granules, tablets or pouches, both packaged in bulk containers and in portions.

In a preferred embodiment, the use according to the invention preferably occurs in a washing and cleaning agent that does not contain bleaching agent. This is understood to mean that the agent does not contain bleaching agent in the narrower sense, i.e. hypochlorites, hydrogen peroxide or substances that yield hydrogen peroxide; the agent preferably does not comprise bleach activators and/or bleach catalysts either.

In a particularly preferred embodiment, the washing agent is a liquid laundry detergent.

In a further particularly preferred embodiment, the washing agent is a powdered or liquid color detergent, i.e. a laundry detergent for colored textiles.

The washing and cleaning agents can also contain other conventional components of washing or cleaning agents, in particular laundry detergents, in particular selected from the group of builders, surfactants, polymers, enzymes, disintegration auxiliaries, fragrances and perfume carriers.

The builders include in particular zeolites, silicates, carbonates, organic cobuilders and also phosphates, provided there are no ecological prejudices against the use thereof.

The microcrystalline, synthetic and bound water-containing zeolite is preferably zeolite A and/or zeolite P. Zeolite MAP® (commercial product from the company Crosfield) is also possible as zeolite P. However, zeolite X and mixtures of zeolite A, X and/or P are also suitable. A co-crystallizate of zeolite X and zeolite A (approx. 80 wt. % zeolite X), which can be described by the formula $$n\mathrm{Na_2O}.(1\text{-}n)\mathrm{K_2O}.\mathrm{Al_2O_3}.(2\text{-}2.5)\mathrm{SiO_2}.(3.5\text{-}5.5)\mathrm{H_2O},$$

is commercially available and can be used in the context of the present invention. The zeolite can in this case be used both as a builder in a granular compound and used for a type of "powdering" of a granular mixture, preferably of a mixture to be compressed, the two ways typically being used to incorporate the zeolite into the premixture. Zeolites can have an average particle size of less than 10 μm (volume distribution; measuring method: Coulter counter) and preferably contain from 18 wt. % to 22 wt. %, in particular from 20 wt. % to 22 wt. %, of bound water.

Crystalline layered silicates of general formula $NaMSi_xO_{2x+1}.y\ H_2O$ can also be used, where M represents sodium or hydrogen, x is a number from 1.9 to 22, preferably from 1.9 to 4, with 2, 3, or 4 being particularly preferred values for x, and y represents a number from 0 to 33, preferably from 0 to 20. The crystalline layered silicates of formula $NaMSi_xO_{2x+1}.y\ H_2O$ are distributed for example by the company Clariant GmbH (Germany) under the trade name Na-SKS. Examples of these silicates are Na-SKS-1 ($Na_2Si_{22}O_{45}.x\ H_2O$, kenyaite), Na-SKS-2 ($Na_2Si_{14}O_{29}.x\ H_2O$, magadiite), Na-SKS-3 ($Na_2Si_8O_{17}.x\ H_2O$) or Na-SKS-4 ($Na_2Si_4O_9.x\ H_2O$, makatite).

Crystalline phyllosilicates of formula $NaMSi_xO_{2x+1}.y\ H_2O$, in which x represents 2, are preferred. In particular, both β- and δ-sodium disilicates $Na_2Si_2O_5.y\ H_2O$ and also especially Na-SKS-5 ($\alpha$-$Na_2Si_2O_5$), Na-SKS-7 ($\beta$-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), in particular however Na-SKS-6 ($\delta$-$Na_2Si_2O_5$), are preferred. Washing or cleansing agents preferably contain a proportion by weight of the crystalline layered silicate of formula $NaMSi_xO_{2x+1}.y\ H_2O$ of from 0.1 wt. % to 20 wt. %, preferably from 0.2 wt. % to 15 wt. %, and in particular from 0.4 wt. % to 10 wt. %.

Amorphous sodium silicates having an $Na_2O:SiO_2$ modulus of from 1:2 to 1:3.3, preferably from 1:2 to 1:2.8, and in particular from 1:2 to 1:2.6, can also be used, which preferably have retarded dissolution and secondary washing properties. The retarded dissolution compared to conventional amorphous sodium silicates can in this case have been caused in a variety of ways, for example by way of surface treatment, compounding, compacting/compression or overdrying. "Amorphous" is understood to mean that the silicates do not supply any sharp X-ray reflexes in X-ray diffraction experiments, such as those that are typical of crystalline substances, but at best cause one or more maxima of the scattered X-rays, which have a width of several degree units of the diffraction angle.

Alternatively or in combination with the aforementioned amorphous sodium silicates, X-ray amorphous silicates can be used, the silicate particles of which supply washed-out or even sharp diffraction maxima in electron diffraction experiments. This is to be interpreted such that the products comprise microcrystalline regions measuring 10 to several hundred nm, with values up to a maximum of 50 nm, and in particular up to a maximum of 20 nm, being preferred. X-ray amorphous silicates of this kind likewise exhibit retarded dissolution compared to conventional water glasses. In particular, compressed/compacted amorphous silicates, compounded amorphous silicates and overdried X-ray amorphous silicates are preferred.

Said silicate(s), preferably alkali silicates, particularly preferably crystalline or amorphous alkali disilicates, are, if present, contained in washing or cleaning agents in amounts of from 3 wt. % to 60 wt. %, preferably from 8 wt. % to 50 wt. %, and in particular from 20 wt. % to 40 wt. %.

It is also possible to use the generally known phosphates as builders, provided that the use thereof should not be avoided for ecological reasons. Among the large number of commercially available phosphates, the alkali metal phosphates, particularly preferably pentasodium triphosphate and pentapotassium triphosphate (sodium tripolyphosphate and potassium tripolyphosphate), are the most important in the washing and cleaning agent industry.

Alkali metal phosphate is in this case the universal term for the alkali metal (in particular sodium and potassium) salts of the various phosphoric acids, of which metaphosphoric acids $(HPO_3)_n$ and orthophosphoric acids $H_3PO_4$ can be distinguished in addition to higher-molecular-weight representatives. The phosphates in this case combine several advantages: They act as alkali carriers, prevent lime deposits on machine parts or lime encrustations in fabrics and in so doing contribute to cleaning performance. Particularly industrially important phosphates are pentasodium triphosphate, $Na_5P_3O_{10}$ (sodium tripolyphosphate) and the corresponding potassium salt pentapotassium triphosphate, $K_5P_3O_{10}$ (potassium tripolyphosphate). Sodium potassium tripolyphosphates are also preferably used. If phosphates are used in washing or cleaning agents, preferred agents therefore contain said phosphate(s), preferably alkali metal phosphate(s), particularly preferably pentasodium triphosphate or pentapotassium triphosphate (sodium tripolyphosphate or potassium tripolyphosphate), in amounts of from 5 wt. % to 80 wt. %, preferably from 15 wt. % to 75 wt. %, and in particular from 20 to 70 wt. %.

Alkali carriers can also be used. Alkali carriers can include, for example, alkali metal hydroxides, alkali metal carbonates, alkali metal hydrogen carbonates, alkali metal sesquicarbonates, the mentioned alkali silicates, alkali metal silicates, and mixtures of the aforementioned substances, it being preferable to use alkali carbonates, in particular sodium carbonate, sodium hydrogen carbonate or sodium sesquicarbonate. A builder system containing a mixture of tripolyphosphate and sodium carbonate can be particularly preferred. Due to the low chemical compatibility thereof with the other ingredients of washing or cleaning agents, in comparison with other builder substances, the alkali metal hydroxides are conventionally only used in small amounts, preferably in amounts below 10 wt. %, more preferably below 6 wt. %, particularly preferably below 4 wt. %, and in particular below 2 wt. %. Agents which contain, based on the total weight thereof, less than 0.5 wt. % and in particular no alkali metal hydroxides are particularly preferred. It is also preferred to use carbonate(s) and/or hydrogen carbonate(s), preferably alkali carbonate(s), particularly preferably sodium carbonate, in amounts of from 2 wt. % to 50 wt. %, preferably from 5 wt. % to 40 wt. %, and in particular from 7.5 wt. % to 30 wt. %.

Polycarboxylates/polycarboxylic acids, polymeric polycarboxylates, aspartic acid, polyacetals, dextrins and phosphonates are particularly noteworthy as organic builders. The polycarboxylic acids that can be used in the form of the free acids and/or the sodium salts thereof can be used, for example, with polycarboxylic acids being understood to mean carboxylic acids that carry more than one acid function. These include, for example, citric acid, adipic acid, succinic acid, glutaric acid, malic acid, tartaric acid, maleic acid, fumaric acid, saccharic acids, aminocarboxylic acids, nitrilotriacetic acid (NTA), provided that the use thereof is not objectionable for ecological reasons, and mixtures thereof. In addition to the builder effect, the free acids typically also have the property of being an acidification component and are thus also used for setting a lower and milder pH of washing or cleaning agents. Citric acid, succinic acid, glutaric acid, adipic acid, gluconic acid, and any mixtures thereof are particularly noteworthy here. Polymeric polycarboxylates are also suitable as builders. These are, for example, the alkali metal salts of polyacrylic acid or polymethacrylic acid, for example those having a relative molecular mass of from 500 g/mol to 70,000 g/mol. Polyacrylates which preferably have a molecular mass of from 2,000 g/mol to 20,000 g/mol are particularly suitable. Due to their superior solubility, the short-chain polyacrylates, which have molar masses of from 2,000 g/mol to 10,000 g/mol, and particularly preferably from 3,000 g/mol to 5,000 g/mol, can be preferred from this group. Copolymeric polycarboxylates are also suitable, in particular those of acrylic acid with methacrylic acid, and acrylic acid or methacrylic acid with maleic acid. Copolymers of acrylic acid with maleic acid, which have from 50 wt. % to 90 wt. % acrylic acid and from 50 wt. % to 10 wt. % maleic acid, have also been found to be particularly suitable. The relative molecular mass thereof, based on free acids, is generally from 2,000 g/mol to 70,000 g/mol, preferably from 20,000 g/mol to 50,000 g/mol, and in particular from 30,000 g/mol to 40,000 g/mol. To improve the water solubility, the polymers can also contain allyl sulfonic acids, such as allyloxybenzene sulfonic acid and methallyl sulfonic acid, as a monomer. The (co)polymeric polycarboxylates can be used as a solid or in aqueous solution. The content of (co)polymeric polycarboxylates in washing or cleaning agents is preferably from 0.5 wt. % to 20 wt. %, and in particular from 3 wt. % to 10 wt. %.

Biodegradable polymers composed of more than two different monomer units are also particularly preferred, such as polymers which contain salts of acrylic acid and of maleic acid and vinyl alcohol or vinyl alcohol derivatives as monomers, or polymers which contain salts of acrylic acid and of 2-alkylallyl sulfonic acid and sugar derivatives as monomers. Further preferred copolymers are those which have acrolein and acrylic acid/acrylic acid salts or acrolein and vinyl acetate as monomers. Polymeric aminodicarboxylic acids, the salts thereof or the precursors thereof should likewise be mentioned as further preferred builders. Polyaspartic acids and/or the salts thereof are particularly preferred.

A further class of substances having builder properties is phosphonates. These are the salts of in particular hydroxyalkane phosphonic acids or aminoalkane phosphonic acids. Of the hydroxyalkane phosphoric acids, 1-hydroxyethane-1,1-diphosphonic acid (HEDP) is particularly important. It is used in particular as a sodium salt, the disodium salt reacting neutral and the tetrasodium salt reacting alkaline. Possible aminoalkane phosphonic acids include in particular ethylenediamine tetramethylene phosphonic acid (EDTMP), diethylenetriamine pentamethylene phosphonic acid (DTPMP) and the higher homologs thereof. They are used in particular in the form of the neutral reacting sodium salts, for example as a hexasodium salt of EDTMP or as a heptasodium salt and octasodium salt of DTPMP. Mixtures of the mentioned phosphonates can also be used as organic builders. In particular, the aminoalkane phosphonates additionally have a pronounced heavy-metal-binding power.

Further suitable builders are polyacetals, which can be obtained by reacting dialdehydes with polyol carboxylic acids which have 5 to 7 C atoms and at least 3 hydroxyl groups. Preferred polyacetals are obtained from dialdehydes such as glyoxal, glutaraldehyde, terephthalaldehyde and mixtures thereof, and from polyol carboxylic acids such as gluconic acid and/or glucoheptonic acid.

Further suitable organic builder substances are dextrins, for example oligomers or polymers of carbohydrates, which can be obtained by the partial hydrolysis of starches. The hydrolysis can be carried out according to customary, for example acid- or enzyme-catalyzed, methods. These dextrins are preferably hydrolysis products having an average molar mass in the range of from 400 g/mol to 500,000 g/mol. In this case, a polysaccharide having a dextrose equivalent (DE) in the range of from 0.5 to 40, in particular from 2 to 30, is preferred, DE being a customary measure for the reducing effect of a polysaccharide compared to dextrose, which has a DE of 100. It is possible to use both maltodextrins having a DE between 3 and 20 and dried glycose syrups having a DE between 20 and 37, and what are known as yellow dextrins and white dextrins having higher molar masses in the range of from 2000 g/mol to 30,000 g/mol. Oxidized derivatives of dextrins of this type are the reaction products thereof with oxidizing agents which are capable of oxidizing at least one alcohol function of the saccharide ring to form a carboxylic acid function.

Oxydisuccinates and other derivatives of disuccinates, preferably ethylenediamine disuccinate, are further suitable cobuilders. Ethylenediamine-N,N'-disuccinate (EDDS) is in this case preferably used in the form of the sodium or magnesium salts thereof. Glycerol disuccinates and glycerol trisuccinates are also preferred in this context. If desired, suitable amounts for use in particular in zeolite-containing and/or silicate-containing formulations are from 3 wt. % to 15 wt. %.

Further organic cobuilders that can be used are, for example, acetylated hydroxycarboxylic acids or the salts thereof, which optionally can also be present in lactone form and comprise at least 4 carbon atoms and at least one hydroxy group, as well as no more than two acid groups.

Furthermore, all compounds that are able to form complexes with alkaline earth ions can be used as builders.

Washing and cleaning agents can contain non-ionic, anionic, cationic and/or amphoteric surfactants.

All non-ionic surfactants that are known to a person skilled in the art can be used as non-ionic surfactants. Washing or cleaning agents particularly preferably contain non-ionic surfactants from the group of alkoxylated alcohols. Non-ionic surfactants that are preferably used are alkoxylated, advantageously ethoxylated, in particular primary alcohols having preferably 8 to 18 C atoms and, on average, 1 to 12 mol of ethylene oxide (EO) per mol of alcohol, in which the alcohol functional group can be linear or preferably methyl-branched in the 2 position, or can contain linear and methyl-branched functional groups in admixture, as are usually present in oxo alcohol functional groups. However, alcohol ethoxylates having linear functional groups of alcohols of native origin having 12 to 18 C atoms, for example of coconut, palm, tallow fatty or oleyl alcohol, and an average of 2 to 8 EO per mol of alcohol, are particularly preferred. Examples of preferred ethoxylated alcohols are $C_{12-14}$ alcohols having 3 EO or 4 EO, $C_{9-11}$ alcohols having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO. The degrees of ethoxylation specified represent statistical averages that can correspond to an integer or a fractional number for a specific product. Preferred alcohol ethoxylates have a narrowed homolog distribution (narrow range ethoxylates, NRE).

Alternatively or in addition to these non-ionic surfactants, fatty alcohols having more than 12 EO can also be used. Examples of these are tallow fatty alcohols having 14 EO, 25 EO, 30 EO or 40 EO. Moreover, alkyl glycosides of general formula $RO(G)_x$ can be used as further non-ionic surfactants, in which formula R corresponds to a primary straight-chain or methyl-branched aliphatic functional group, in particular an aliphatic functional group that is methyl-branched in the 2 position, having 8 to 22, preferably 12 to 18, C atoms, and G is the symbol that represents a glycose unit having 5 or 6 C atoms, preferably glucose. The degree of oligomerization x, which indicates the distribution of monoglycosides and oligoglycosides, is any number between 1 and 10; xis preferably from 1.2 to 1.4.

Another class of nonionic surfactants that are preferably used, which are used either as the sole non-ionic surfactant or in combination with other non-ionic surfactants, are alkoxylated, preferably ethoxylated or ethoxylated and propoxylated fatty acid alkyl esters, preferably having 1 to 4 carbon atoms in the alkyl chain.

Non-ionic surfactants of the amine oxide type, for example N-cocoalkyl-N,N-dimethylamine oxide and N-tallow alkyl-N,N-dihydroxyethylamine oxide, and of the fatty acid alkanolamide type can also be used. The amount of these non-ionic surfactants is preferably no more than that of the ethoxylated fatty alcohols, in particular no more than half thereof.

Further suitable surfactants are polyhydroxy fatty acid amides of the formula,

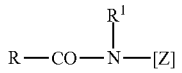

in which R represents an aliphatic acyl functional group having 6 to 22 carbon atoms, $R^1$ represents hydrogen, an alkyl functional group or hydroxyalkyl functional group having 1 to 4 carbon atoms, and [Z] represents a linear or branched polyhydroxyalkyl functional group having 3 to 10 carbon atoms and 3 to 10 hydroxyl groups. The polyhydroxy fatty acid amides are known substances that can usually be obtained by the reductive amination of a reducing sugar with ammonia, an alkylamine or an alkanolamine, and subsequent acylation with a fatty acid, a fatty acid alkyl ester or a fatty acid chloride. The group of polyhydroxy fatty acid amides also includes compounds of formula

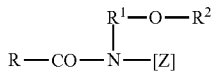

in which R represents a linear or branched alkyl or alkenyl functional group having 7 to 12 carbon atoms, $R^1$ represents a linear, branched or cyclic alkyl functional group or an aryl functional group having 2 to 8 carbon atoms, and $R^2$ represents a linear, branched or cyclic alkyl functional group or an aryl functional group or an oxy alkyl functional group having 1 to 8 carbon atoms, $C_{1-4}$ alkyl or phenyl functional groups being preferred, and [Z] represents a linear polyhydroxy alkyl functional group, the alkyl chain of which is substituted with at least two hydroxyl groups, or alkoxylated, preferably ethoxylated or propoxylated, derivatives of this functional group. [Z] is preferably obtained by the reductive amination of a reduced sugar, for example glucose, fructose, maltose, lactose, galactose, mannose or xylose. The N-alkoxy-substituted or N-aryloxy-substituted compounds can be converted, in the presence of an alkoxide as the catalyst, into the desired polyhydroxy fatty acid amides by reacting these with fatty acid methyl esters.

In cleaning agents, non-ionic surfactants from the group of alkoxylated alcohols, particularly preferably from the group of mixed alkoxylated alcohols and in particular from the group of EO/AO/EO non-ionic surfactants, or PO/AO/PO non-ionic surfactants, especially PO/EO/PO non-ionic surfactants, are particularly preferred. PO/EO/PO non-ionic surfactants of this kind are distinguished by good foam control.

Anionic surfactants that are used are those of the sulfonate and sulfate types, for example. Surfactants of the sulfonate type that can be used are in this case preferably $C_{9-13}$ alkylbenzene sulfonates, olefin sulfonates, i.e. mixtures of alkene and hydroxyalkane sulfonates, and disulfonates, as they are obtained, for example, from $C_{12-18}$ monoolefins having a terminal or internal double bond by way of sulfonation with gaseous sulfur trioxide and subsequent alkaline or acid hydrolysis of the sulfonation products. Alkane sulfonates obtained from $C_{12-18}$ alkanes, for example by way of sulfochlorination or sulfoxidation with subsequent hydrolysis or neutralization, are also suitable. Likewise, the esters of α-sulfofatty acids (ester sulfonates) are suitable, for example the α-sulfonated methyl esters of hydrogenated coconut fatty acids, palm kernel fatty acids or tallow fatty acids.

Sulfated fatty acid glycerol esters are further suitable anionic surfactants. Fatty acid glycerol esters are understood to mean the monoesters, diesters and triesters and the mixtures thereof, as they are obtained during production by way of esterification of a monoglycerol having 1 to 3 mol of fatty acid or during the transesterification of triglycerides having 0.3 to 2 mol of glycerol. Preferred sulfated fatty acid glycerol esters are in this case the sulfation products of saturated fatty acids having 6 to 22 carbon atoms, for example of caproic acid, caprylic acid, capric acid, myristic acid, lauric acid, palmitic acid, stearic acid or behenic acid.

The alkali salts and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having this chain length are preferred as alk(en)yl sulfates. Alk(en)yl sulfates having the described chain length that include a synthetic straight-chain alkyl functional group produced on a petrochemical basis, and have a similar degradation behavior as the adequate compounds based on fatty chemical raw materials, are also preferred. From a washing perspective, the $C_{12}$-$C_{16}$ alkyl sulfates, $C_{12}$-$C_{15}$ alkyl sulfates, and $C_{14}$-$C_{15}$ alkyl sulfates are preferred.

The sulfuric acid monoesters of straight-chain or branched $C_{7-21}$ alcohols ethoxylated with 1 to 6 mol of ethylene oxide, such as 2-methyl-branched $C_{9-11}$ alcohols having, on average, 3.5 mol of ethylene oxide (EO) or $C_{12-18}$ fatty alcohols having 1 to 4 EO, are also suitable. Due to the high foaming behavior thereof, they are used in cleaning agents only in relatively small amounts, for example in amounts of from 1 wt. % to 5 wt. %.

Further suitable anionic surfactants are also the salts of alkyl sulfosuccinic acid, which are also referred to as sulfosuccinates or as sulfosuccinic acid esters and represent the monoesters and/or diesters of sulfosuccinic acid with alcohols, preferably fatty alcohols, and in particular ethoxylated fatty alcohols. Preferred sulfosuccinates contain $C_{8-18}$ fatty alcohol functional groups or mixtures thereof. In particular, preferred sulfosuccinates contain a fatty alcohol functional group that is derived from ethoxylated fatty alcohols, which, considered in isolation, represent non-ionic surfactants. In this case, sulfosuccinates of which the fatty alcohol functional groups derive from ethoxylated fatty alcohols exhibiting a restricted homolog distribution are in turn particularly preferred. Likewise, it is also possible to use alk(en)yl succinic acid having preferably 8 to 18 carbon atoms in the alk(en)yl chain, or the salts thereof.

In particular, soaps are possible as further anionic surfactants. Saturated fatty acid soaps are suitable, such as the salts of lauric acid, myristic acid, palmitic acid, stearic acid, hydrogenated erucic acid and behenic acid, and in particular soap mixtures derived from natural fatty acids, such as coconut fatty acids, palm kernel fatty acids or tallow fatty acids.

The anionic surfactants, including the soaps, can be present in the form of the sodium, potassium or ammonium salts thereof, and as soluble salts of organic bases, such as monoethanolamine, diethanolamine or triethanolamine. The anionic surfactants are preferably present in the form of the sodium or potassium salts thereof, in particular in the form of the sodium salts.

Instead of the mentioned surfactants or in conjunction therewith, cationic and/or amphoteric surfactants can also be used.

Cationic compounds of the following formulae can be used as cationic active substances, for example:

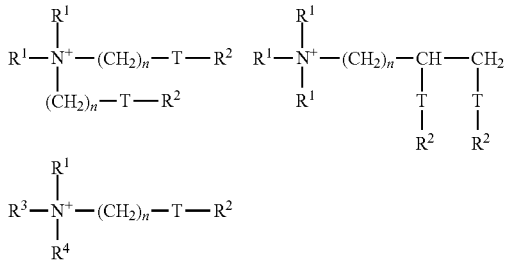

where each group $R^1$, independently of one another, is selected from $C_{1-6}$ alkyl groups, $C_{1-6}$ alkenyl groups or $C_{1-6}$ hydroxyalkyl groups; each group $R^2$, independently of one another, is selected from $C_{8-28}$ alkyl groups or $C_{8-28}$ alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO— or —CO—O—; and n is an integer from 0 to 5.

Textile-softening compounds can be used in order to care for the textiles and improve the textile properties such as a softer "feel" (softening) and lower electrostatic charge (increased wearing comfort). The active ingredients of these formulations are quaternary ammonium compounds having two hydrophobic functional groups, such as distearyl dimethyl ammonium chloride, which is however, due to the insufficient biodegradability thereof, increasingly being replaced by quaternary ammonium compounds which contain ester groups in the hydrophobic functional groups thereof as predetermined breaking points for biodegradation.

"Esterquats" of this kind that have improved biodegradability can be obtained, for example, by esterifying mixtures of methyldiethanolamine and/or triethanolamine with fatty acids and subsequently quaternizing the reactions products with alkalizing agents in a manner known per se. Dimethylol ethylene urea is also suitable as a finish.

Enzymes can be used to increase the performance of washing or cleaning agents. These include, in particular, proteases, amylases, lipases, hemicellulases, cellulases, perhydrolases, or oxidoreductases, and preferably the mixtures thereof. In principle, these enzymes are of natural origin; starting from the natural molecules, improved variants for use in washing and cleaning agents are available which are correspondingly preferably used. Washing or cleaning agents contain enzymes preferably in total amounts of from $1\times10^{-6}$ wt. % to 5 wt. %, based on active protein. The protein concentration can be determined with the aid of known methods, for example the BCA method or the Biuret method.

Of the proteases, proteases of the subtilisin-type are preferred. Examples of these are the subtilisins BPN' and Carlsberg, as well as the further-developed forms thereof, protease PB92, subtilisins 147 and 309, the alkaline protease from *Bacillus lentus*, subtilisin DY, and the enzymes thermitase, proteinase K and proteases TW3 and TW7, which belong to the subtilases but no longer to the subtilisins in the narrower sense.

Examples of amylases that can be used are α-amylases from *Bacillus licheniformis*, from *B. amyloliquefaciens*, from *B. stearothermophilus*, from *Aspergillus niger* and *A. oryzae*, as well as the further developments of the above-mentioned amylases that have been improved for use in washing and cleaning agents. Furthermore, the α-amylases from *Bacillus* sp. A 7-7 (DSM 12368) and the cyclodextrin glucanotransferase (CGTase) from *B. agaradherens* (DSM 9948) are particularly noteworthy for this purpose.

Lipases or cutinases can be used because of the triglyceride-cleaving activity thereof. These include, for example, the lipases that can originally be obtained from *Humicola lanuginosa* (*Thermomyces lanuginosus*) or have been further developed therefrom, in particular those having the amino acid exchange D96L. Moreover, the cutinases which have been originally isolated from *Fusarium solani pisi* and *Humicola insolens* can also be used, for example. Lipases and/or cutinases of which the starting enzymes were originally isolated from *Pseudomonas mendocina* and *Fusarium solanii* can also be used.

Moreover, enzymes can be used which can be grouped together under the term "hemicellulases." These include, for example, mannanases, xanthan lyases, pectin lyases (=pectinases), pectinesterases, pectate lyases, xyloglucanases (=xylases), pullulanases, and β-glucanases.

In order to increase the bleaching effect, oxidoreductases such as oxidases, oxygenases, catalases, peroxidases such as halo-, chloro-, bromo-, lignin, glucose or manganese peroxidases, dioxygenases or laccases (phenoloxidases, polyphenoloxidases) can be used if desired. Advantageously, organic, particularly preferably aromatic, compounds that interact with the enzymes are additionally added in order to increase the activity of the relevant oxidoreductases (enhancers) or, in the event of greatly differing redox potentials, to ensure the flow of electrons between the oxidizing enzymes and the stains (mediators).

The enzymes can be used in any form established in the prior art. These include, for example, the solid preparations obtained by way of granulation, extrusion, or lyophilization or, particularly in the case of liquid or gel agents, solutions of the enzymes, advantageously maximally concentrated, low-moisture, and/or supplemented with stabilizers. Alternatively, the enzymes can also be encapsulated for both the solid and liquid dosage form, for example through spray-drying or extrusion of the enzyme solution together with a preferably natural polymer, or in the form of capsules, for example those in which the enzymes are enclosed in a set gel, or in those of the core-shell type in which an enzyme-containing core is coated with a water-, air-, and/or chemical-impermeable protective layer. In the case of overlaid layers, other active ingredients, such as stabilizers, emulsifiers, pigments, bleaching agents, or dyes, can be additionally applied. Capsules of this kind are applied using methods that are known per se, for example by way of shaking or roll granulation or in fluidized bed processes. Granulates of this kind are advantageously low in dust, for example due to the application of polymeric film-formers, and stable in storage due to the coating. Moreover, it is possible to formulate two or more enzymes together, so that a single granulate has several enzyme activities.

One or more enzymes and/or enzyme preparations, preferably protease preparations and/or amylase preparations, are preferably used in amounts of from 0.1 wt. % to 5 wt. %, preferably from 0.2 wt. % to 4.5 wt. %, and in particular from 0.4 wt. % to 4 wt. %.

Individual odorant compounds, such as synthetic products of the ester, ether, aldehyde, ketone, alcohol, and hydrocarbon types, can be used as a perfume oil or fragrance. However, mixtures of different odorants are preferably used which together produce an appealing scent. Perfume oils of this kind can also contain natural odorant mixtures, as are obtainable from plant sources, e.g. pine, citrus, jasmine, patchouli, rose or ylang-ylang oil. In order to be perceptible, an odorant must be volatile, with the molar mass also playing an important role in addition to the nature of the functional groups and the structure of the chemical compound. Therefore, most odorants have molar masses of up to approximately 200 g/mol, whereas molar masses of 300 g/mol and above represent something of an exception. Due to the differing volatility of odorants, the odor of a perfume or fragrance composed of a plurality of odorants varies over the course of evaporation, the odor impressions being divided into "top note," "middle note or body" and "end note or dry out." Because the perception of an odor also depends to a large extent on the odor intensity, the top note of a perfume or fragrance does not only consist of highly volatile compounds, whereas the end note consists for the most part of less volatile, i.e. adherent, odorants. When composing perfumes, more volatile odorants can be bound for example to specific fixatives, thereby preventing them from evaporating too quickly. The following subdivision of odorants into "more volatile" and "adherent" odorants therefore provides no information with regard to the odor impression, and as to whether the corresponding odorant is perceived as a top or middle note. The fragrances can be processed directly, but it can also be advantageous to apply the fragrances to carriers which ensure long-lasting fragrance by slowly releasing the fragrance. Cyclodextrins have been found to be expedient as carrier materials of this kind, it also being possible to additionally coat the cyclodextrin perfume complexes with further auxiliaries.

When choosing the dye, it should be noted that the dye can have a high storage stability and sensitivity to light and not have an excessive affinity compared with textile surfaces and in this case in particular compared with synthetic fibers. It should also be noted that dyes can have different stabilities with respect to oxidation. Water-insoluble dyes are generally more stable against oxidation than water-soluble dyes. The concentration of the dye in the washing or cleaning agents varies depending on the solubility and therefore also on the sensitivity to oxidation. For highly water-soluble dyes, dye concentrations in the range of a few $10^{-2}$ wt. % to $10^{-3}$ wt. % are typically selected. However, for the pigment dyes that are preferred in particular due to their brightness, but are however less water-soluble, the suitable concentration of the dye in washing or cleaning agents is typically from a few $10^{-3}$ wt. % to $10^{-4}$ wt. %. Dyes which can be oxidatively destroyed in the washing process, and mixtures thereof with suitable blue dyes, which are referred to as blue toners, are preferred. It has been shown to be advantageous to use dyes which are soluble in water or in liquid organic substances at room temperature. For example, anionic dyes, for example anionic nitroso dyes, are suitable.

In addition to the previously mentioned components, the washing or cleaning agents can contain further ingredients which further improve the practical and/or aesthetic properties of these agents. Preferred agents contain one or more substances from the group of electrolytes, pH adjusting agents, fluorescing agents, hydrotropes, foam inhibitors, silicone oils, anti-redeposition agents, optical brighteners, graying inhibitors, anti-shrink agents, anti-crease agents, dye transfer inhibitors, antimicrobial active ingredients, germicides, fungicides, antioxidants, antistatic agents, ironing aids, repellents and impregnating agents, anti-swelling and anti-slip agents, and UV absorbers.

A large number of a wide range of salts can be used as electrolytes from the group of inorganic salts. Preferred cations are the alkali and alkaline-earth metals; preferred anions are the halides and sulfates. From a technical manufacturing point of view, the use of NaCl or $MgCl_2$ in the washing or cleaning agents is preferred.

In order to bring the pH of washing or cleaning agents into the desired range, the use of pH adjusting agents can be advisable. In this case, all known acids or liquors can be used, provided the use thereof is not prohibited for practical or ecological reasons or for reasons of consumer protection. The amount of this adjuster does not usually exceed 1 wt. % of the total formulation.

Soaps, oils, fats, paraffins or silicone oils are possible foam inhibitors, which can optionally be applied to carrier materials. Suitable carrier materials include, for example, inorganic salts such as carbonates or sulfates, cellulose derivatives or silicates and mixtures of the aforementioned materials. Within the scope of the present invention, preferred agents contain paraffins, preferably unbranched paraffins (n-paraffins) and/or silicons, preferably linear-polymeric silicons, which are composed according to the formula $(R_2SiO)_x$ and are also referred to as silicone oils. These silicone oils represent usually clear, colorless, neutral, odorless, hydrophobic liquids having a molecular weight between 1,000 g/mol and 150,000 g/mol and viscosities between 10 mPas and 1,000,000 mPas.

Suitable anti-redeposition agents are, for example, non-ionic cellulose ethers such as methylcellulose and methylhydroxypropylcellulose having a proportion of methoxy groups of from 15 to 30 wt. % and of hydroxypropyl groups of from 1 to 15 wt. %, in each case based on the non-ionic cellulose ether.

Soil repellents include the polymers of phthalic acid and/or terephthalic acid known from the prior art or the derivatives thereof, in particular polymers from ethylene terephthalate and/or polyethylene glycol terephthalate or anionically and/or non-ionically modified derivatives thereof. Of these, the sulfonated derivatives of phthalic acid polymers and terephthalic acid polymers are particularly preferred.

Optical brighteners can in particular be added to the washing agents in order to eliminate graying and yellowing of the treated textiles. These substances absorb into the fibers and cause a lightening and pretend bleach effect, by converting invisible ultraviolet radiation into visible long-wave light, the ultraviolet light absorbed from the sunlight being emitted as light-blue fluorescence and, together with the yellow tone of the grayed or yellowed laundry, producing pure white. Suitable compounds originate for example from the substance classes of 4,4'-diamino-2,2'-stilbene disulfonic acids (flavonic acid), 4,4'-distyrylbiphenylene, methylumbelliferone, cumarines, dihydroquinolones, 1,3-diarylpyrazolines, naphthalic acid imides, benzoxazole systems, benzisoxazole systems, benzimidazole systems and pyrene derivatives substituted with heterocycles.

The function of graying inhibitors is to keep the dirt removed from the fibers suspended in the liquor and to therefore prevent the redeposition of the dirt. Water-soluble colloids, which are usually organic, are suitable for this purpose, for example the water-soluble salts of polymeric carboxylic acids, sizing material, gelatin, salts of ethersulfonic acids of starch or cellulose, or salts of acidic sulfuric acid esters of cellulose or starch. Water-soluble polyamides containing acidic groups are also suitable for this purpose. Soluble starch preparations can also be used, for example degraded starch and/or aldehyde starches. Polyvinylpyrrolidone can also be used. Cellulose ethers such as carboxymethyl cellulose (Na salt), methyl cellulose, hydroxyalkyl cellulose, and mixed ethers such as methylhydroxyethyl cellulose, methylhydroxypropyl cellulose, methylcarboxymethyl cellulose and mixtures thereof, can also be used as graying inhibitors.

Since textile fabrics, in particular those made of rayon, spun rayon, cotton and mixtures thereof, can tend to crease, because the individual fibers are sensitive to bending, kinking, pressing and crushing transversely to the fiber direction, synthetic anti-crease agents can be used. These include, for example, synthetic products based on fatty acids, fatty acid esters, fatty acid amides, fatty acid alkylol esters, fatty acid alkylolamides or fatty alcohols which are mostly reacted with ethylene oxide, or products based on lecithin or modified phosphoric acid ester.

Repellant and impregnating methods are used to finish the textiles with substances which prevent the deposition of dirt or make it easier to wash said dirt out. Preferred repellants and impregnating agents are perfluorated fatty acids, also in the form of the aluminum and zirconium salts thereof, organic silicates, silicons, polyacrylic acid esters having perfluorated alcohol components or polymerizable compounds coupled to a perfluorated acyl or sulfonyl functional group. Antistatic agents can also be contained. The dirt-repellant finishing using repellants and impregnating agents is often classed as easy-care finishing. It is possible to facilitate the penetration of impregnating agents in the form of solutions or emulsions of the relevant active ingredients by adding wetting agents which reduce the surface tension. A further field of application of repellants and impregnating agents is the water-repellant finishing of textile goods, tents, tarpaulins, leather, etc., in which, in contrast to waterproofing, the fabric pores are not closed and the substance therefore remains breathable (hydrophobizing). The hydrophobizing agents used for hydrophobizing coat textiles, leather, paper, wood, etc. with a very thin layer of hydrophobic groups, such as longer alkyl chains or siloxane groups. Suitable hydrophobizing agents are, for example, paraffins, waxes, metallic soaps etc. having additives of aluminum or zirconium salts, quaternary ammonium compounds having long-chain alkyl functional groups, urea derivatives, fatty acid-modified melamine resins, chromium complex salts, silicons, organotin compounds and glutardialdehyde and perfluorinated compounds. The hydrophobized materials do not feel oily; instead, similar to oiled substances, water droplets drip off said materials without wetting them. Silicon-impregnated textiles, for example, therefore have a soft feel and are water and dirt repellent; marks from ink, wine, fruit juices and the like are easier to remove.

Antimicrobial active ingredients can be used to combat microorganisms. Here a distinction is made, depending on the antimicrobial spectrum and mechanism of action, between bacteriostatic agents and bactericides, fungistatic agents and fungicides. Substances from these groups are, for example, benzalkonium chlorides, alkylarlyl sulfonates, halophenols and phenylmercury acetate, it also being possible to omit these compounds entirely.

In order to prevent undesired changes to the washing and cleaning agents and/or to the treated textiles caused by the effect of oxidizing agents and other oxidative processes, the agents can contain antioxidants. This compound class includes, for example, substituted phenols, hydroquinones, catechols and aromatic amines, and organic sulfides, polysulfides, dithiocarbamates, phosphites and phosphonates.

Increased wearing comfort can result from the additional use of antistatic agents. Antistatic agents increase the surface conductivity and therefore facilitate improved flowing off of charges formed. External antistatic agents are generally substances that have at least one hydrophilic molecule ligand and produce a more or less hygroscopic film on the surface. These predominantly surface-active antistatic agents can be divided into nitrogen-containing antistatic agents (amines, amides, quaternary ammonium compounds), phosphorous-containing antistatic agents (phosphoric acid ester) and sulfur-containing antistatic agents (alkyl sulfonates, alkyl sulfates). Lauryl (or stearyl) dimethyl benzyl ammonium chlorides are also suitable as antistatic agents for textiles or as an additive in washing agents, a softening effect additionally being achieved.

Silicone derivatives can be used in textile detergents in order to improve the water-absorption capability and the re-wettability of the treated textiles and in order to facilitate ironing of the treated textiles. These also improve the rinsing behavior of washing or cleaning agents as a result of the foam-inhibiting properties thereof. Preferred silicone derivatives are, for example, polydialkylsiloxanes or alkylarylsiloxanes, in which the alkyl groups have 1 to 5 C atoms and are completely or partially fluorinated. Preferred silicons are polydimethylsiloxanes, which can optionally be derivatized and are then aminofunctional or quaternized, or have Si—OH—, Si—H— and/or Si—Cl— bonds. Further preferred silicons are polyalkylene oxide-modified polysiloxanes, i.e. polysiloxanes which comprise for example polyethylene glycol, and polyalkylene oxide-modified dimethylpolysiloxanes.

Lastly, UV absorbers can also be used which absorb into the treated textiles and improve the light resistance of the fibers. Compounds which have these desired properties are, for example, the active compounds from non-radiative deactivation and derivatives of benzophenone having substituents in the 2 and/or 4 position. Substituted benzotriazoles, acrylates that are phenyl-substituted in the 3 position (cinnamic acid derivates), optionally having cyano groups in the 2 position, salicylates, organic Ni complexes and natural substances such as umbelliferone and the endogenous urocanic acid are also suitable.

Protein hydrolyzates are further suitable active substances due to the fiber-caring effect thereof. Protein hydrolyzates are product mixtures that are obtained by acid-, base-, or enzyme-catalyzed degradation of proteins. Protein hydrolyzates of both plant and animal origin can be used. Animal protein hydrolyzates are, for example, elastin, collagen, keratin, silk, and milk protein hydrolyzates, which can also be present in the form of salts. It is preferable to use protein hydrolyzates of plant origin, for example soy, almond, rice, pea, potato and wheat protein hydrolyzates. Although the use of protein hydrolyzates is preferred as such, amino acid mixtures otherwise obtained or individual amino acids such as arginine, lysine, histidine or pyroglutamic acid can optionally also be used in their place. The use of derivatives of protein hydrolyzates, for example in the form of the fatty acid condensation products thereof, is also possible.

EXAMPLES

Example 1: Synthesis of 2,3-dihydroxy-N,N'-bis(2-(dimethylamino)ethyl) terephthaldiamide (S1)

a) Preparation of 2,3-dihydroxyterephthalic acid dimethyl ester

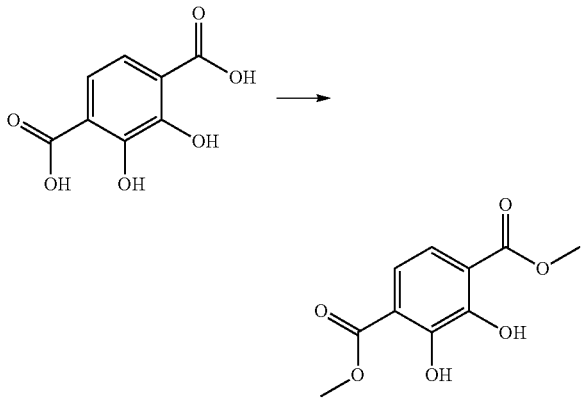

96% sulfuric acid (3.14 g, 32 mmol) was slowly added dropwise, while stirring, to a suspension of 2,3-dihydroxyterephthalic acid (9.39 g, 45 mmol) in methanol (500 ml). The reaction mixture was heated to 65° C. and stirred under reflux for 70 h. The reaction solution was subsequently cooled to room temperature and the solvent was removed under reduced pressure. The residue was absorbed into an aqueous saturated $NaHCO_3$ solution (300 ml) and extracted with dichloromethane (3×400 ml). The organic phase was dried with magnesium sulfate and filtered, and the solvent was removed under reduced pressure. 2,3-dihydroxyterephthalic acid dimethyl ester (5.9 g, 26.1 mmol, 58%) was obtained as a beige solid.

b) Preparation of 2,3-dihydroxy-N,N'-bis(2-(dimethylamino)ethyl) terephthaldiamide

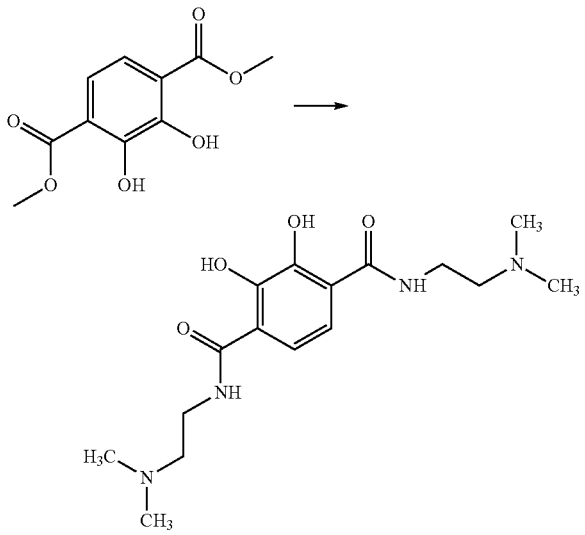

2,3-dihydroxyterephthalic acid dimethyl ester (12.89 g, 57 mmol) from step a) was suspended in N,N-dimethylethylenediamine (72.8 g, 809 mmol) and the reaction mixture was stirred for 24 hours at 100° C. After adding 100 ml of dimethylformamide (DMF), the excess of N,N-dimethylethylenediamine, together with the DMF, was removed by distillation. The solid obtained was washed 2 times using 300 ml of ethyl acetate, subsequently recrystallized from methanol/ethyl acetate (1:2.5) and dried in a vacuum. 9.6 g of 2,3-dihydroxy-N,N'-bis(2-(dimethylamino)ethyl)terephthaldiamide was obtained as a beige solid. The water solubility thereof (deionized water, pH 7, room temperature) was over 70 g/l.

$^1$H-NMR ($D_2O$): δ=7.12 (2H; Ar); 3.72 (4H; 2 $CH_2$); 3.07 (4H; 2 $CH_2$); 2.68 (12H; 4 $CH_3$)

Example 2: Cleaning Performance

Washing tests were carried out at 40° C. as a triple determination on standardized stains, specified in table 1, on cotton, an aqueous liquid washing agent that is free of bleaching agent (and contains, in addition to water, 5.5 wt. % 7-fold ethoxylated $C_{12/14}$ fatty alcohol, 5.3 wt. % sodium $C_{9-13}$ alkylbenzene sulfonate, 4.9 wt. % sodium $C_{12/14}$ fatty alcohol ether sulfate having 2 EO, 1.8 wt. % citric acid, 3 wt. % $C_{12-18}$ fatty acid, 0.1 wt. % diethylene triamine penta (methylene phosphonic acid) hepta sodium salt, 1.3 wt. % NaOH, 3.6 wt. % ethanol/glycerol) having a pH of 8.5 having been used and washing liquors having been prepared therewith, the washing liquors consisting of 70 g of the liquid washing agent or 70 g of the liquid washing agent and 0.7 g Si from example 1 in every 17 l water of 16° dH. The evaluation was completed by measuring the color distance according to the L*a*b* vales and the Y values calculated therefrom as a measure for brightness. The following table shows the d(dY) values which resulted from the differences in the differential Y (after washing)−Y (before washing) between the use of the liquid washing agent together with Si and the liquid washing agent alone.

TABLE 1

| d(d)Y values | |
|---|---|
| Stain | d(dY) |
| Bilberry juice | 8.0 |
| Blackcurrant juice | 4.5 |
| Red wine | 3.3 |

TABLE 1-continued

| d(d)Y values | |
|---|---|
| Stain | d(dY) |
| Coffee | 3.7 |
| Cocoa | 4.6 |

What is claimed is:

1. A method for treating stained textiles comprising the step of contacting the stained textile in a wash liquor with a compound of general formula (I),

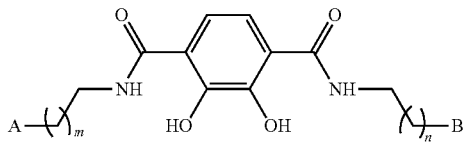

(I)

in which m and n, independently of one another, represent 1 to 2 and A and B, independently of one another, represent —$N^+R^1R^2R^3X^-$, —$SO_3H$ or —$SO_3^-Y^+$, and $R^1$, $R^2$ and $R^3$, independently of one another, represent H or a straight-chain or branched-chain aliphatic hydrocarbon functional group having 1 to 3 carbon atoms, $X^-$ represents an anion and $Y^+$ represents an alkali metal cation or an ammonium ion, wherein said compound of general formula (I) is present in washing or cleaning agents.

2. The method according to claim 1, wherein the stained textile comprises a stain consisting of polymerizable substances selected from polyphenolic dyes.

3. The method according to claim 2, characterized in that the stain is selected from stains caused by cherries, morello cherries, grapes, apples, pomegranates, chokeberries, plums, sea buckthorns, acai, kiwifruit, mango, grass, berries, coffee, tea, red cabbage, blood orange, eggplant, tomato, carrots, beetroot, spinach, paprika, red or blue potatoes, or red onions.

4. The method according to claim 1, characterized in that, in the compounds of general formula (I), A and B are the same or are not oppositely charged.

5. The method according to claim 1, characterized in that, in the compounds of general formula (I), $X^-$ is selected from the group consisting of lactate, citrate, tartrate, succinate, perchlorate, tetrafluoroborate, hexafluorophosphate, alkyl sulfonate, alkyl sulfate, hydrogen sulfate, sulfate, dihydrogen phosphate, hydrogen phosphate, phosphate, isocyanate, thiocyanate, nitrate, fluoride, chloride, bromide, hydrogen carbonate and carbonate and mixtures of at least two thereof.

* * * * *